US011045964B2

(12) United States Patent
Koike

(10) Patent No.: US 11,045,964 B2
(45) Date of Patent: Jun. 29, 2021

(54) ROTARY ELECTRIC SHAVER WITH MAGNET BIASED BLADE UNITS

(71) Applicant: Izumi Products Company, Matsumoto (JP)

(72) Inventor: Hideaki Koike, Matsumoto (JP)

(73) Assignee: Maxell Izumi Co., Ltd., Matsumoto (JP)

( * ) Notice: Subject to any disclaimer, the term of this patent is extended or adjusted under 35 U.S.C. 154(b) by 35 days.

(21) Appl. No.: 16/199,742

(22) Filed: Nov. 26, 2018

(65) Prior Publication Data

US 2019/0176352 A1 Jun. 13, 2019

(30) Foreign Application Priority Data

Dec. 8, 2017 (JP) ..... JP2017-235719

(51) Int. Cl.
*B26B 19/14* (2006.01)

(52) U.S. Cl.
CPC ..... *B26B 19/145* (2013.01); *B26B 19/14* (2013.01); *B26B 19/141* (2013.01)

(58) Field of Classification Search
CPC ..... B26B 19/14; B26B 19/141; B26B 19/145; B26B 19/143; B26B 19/146; B26B 19/148; B26B 19/04; B26B 19/044; B26B 19/046; B26B 19/048
See application file for complete search history.

(56) References Cited

U.S. PATENT DOCUMENTS

| | | | | |
|---|---|---|---|---|
| 7,222,428 | B2 * | 5/2007 | Koike | B26B 19/14 30/346.51 |
| 8,533,960 | B1 * | 9/2013 | Barish | B26B 19/14 30/43.6 |
| 2011/0173815 | A1 | 7/2011 | Koike | |

FOREIGN PATENT DOCUMENTS

| | | | |
|---|---|---|---|
| DE | 20 2013 104680 | U1 | 11/2013 |
| EP | 2 138 283 | A1 | 12/2009 |
| EP | 2 246 159 | A2 | 11/2010 |
| JP | H1-82877 | U | 6/1989 |
| JP | 2016-514557 | A | 5/2016 |

OTHER PUBLICATIONS

The extended European search report for the corresponding EP application 18210583.3 dated Apr. 25, 2019.

* cited by examiner

*Primary Examiner* — Jason Daniel Prone
*Assistant Examiner* — Samuel A Davies
(74) *Attorney, Agent, or Firm* — Muncy, Geissler, Olds & Lowe, P.C.

(57) ABSTRACT

A rotary electric shaver includes a main body in which a first transmission mechanism, and a connecting portion is disposed; a head unit in which a plurality of blade units each having an outer blade, an inner blade being in sliding contact with an inner surface of the outer blade, and a driven shaft rotating the inner blade are disposed, and a second transmission mechanism that transmits a power of the first transmission mechanism to rotate the driven shaft is built, and which is connected to the connecting portion. The head unit has a first magnet disposed at a position corresponding to each of the blade units. The main body has a second magnet disposed at a position facing and repelling the first magnet.

3 Claims, 4 Drawing Sheets

ROTARY ELECTRIC SHAVER WITH MAGNET BIASED BLADE UNITS

CROSS-REFERENCE TO RELATED APPLICATION

This application is based upon and claims the benefit of priority of the prior Japanese Patent Application No. P2017-235719, filed on Dec. 8, 2017, and the entire contents of which are incorporated herein by reference.

TECHNICAL FIELD

The present invention relates to a rotary electric shaver.

BACKGROUND ART

A rotary electric shaver includes a main body in which a motor is built, a head unit having a plurality of blade units each having an outer blade which has a circular shaving surface on an outer side, and an inner blade which is in sliding contact with on an inner surface of the outer blade, and a driving power transmission mechanism transmitting driving power from the motor to rotate the inner blade, and has a structure in which the head unit is connected to a connecting portion disposed in the main body.

In the related art, with respect to a connection structure of the head unit in the rotary electric shaver, there is known a configuration in which a compression spring is inserted through a connecting shaft of the connecting portion to cause the head unit to be movable upon pushing (PTL 1: JP-T-2016-514557). In addition, in a reciprocating-type electric shaver having a structure which has one blade unit having an outer blade having an inverted U-shape in cross section and an inner blade which is in sliding contact with a lower surface of the outer blade, there is known a configuration in which magnets which repulsively react with each other are inserted through a connecting shaft of a main body to cause the head unit to be movable upon pushing (PTL 2: JP-UM-A-1-82877).

SUMMARY OF INVENTION

Technical Problem

As in PTL 1, in the configuration in which the compression spring is inserted through the connecting shaft of the connecting portion, in a case where the head unit and the main body close to each other while being coaxial with the connecting shaft, a pressing force is exerted in a direction compressing the compression spring. Therefore, a restoring force of the compression spring acts in a direction in which the head unit and the main body go away from each other while being coaxial with the connecting shaft.

However, in a case where the head unit is pressed against a skin surface at a position distant from the connecting shaft, almost no pressing force acts in a direction compressing the compression spring, so that the restoring force of the compression spring also hardly acts. Therefore, if the pressing force by a user is strong, the pressing force is transmitted to the skin surface as it is, and the outer blade strongly presses the skin surface, and if the pressing force by a user is weak, the pressing force is transmitted to the skin surface as it is, and the outer blade weakly presses the skin surface.

Normally, when the head unit is pressed against the skin surface, the user is not so conscious of whether or not it is at a position distant from the connecting shaft and pushes the head unit against the skin surface with a substantially constant force. Therefore, in a case of the configuration of PTL 1, for example, when a position close to an outer periphery of the head unit comes into contact with a portion of a jaw or the like where undulation (irregularity) of the skin surface is relatively large, there is a problem that a variation of a force with which the outer blade presses the skin surface increases and as a result, a followability of the outer blade to the skin surface deteriorates. The problem is a factor of hindering a sufficient deep shaving, as well as a factor of leaving some hairs unshaved. In this invention, examples of the hairs include beards, mustache, whisker, and the like.

In addition, even if the configuration in which magnets which repulsively react with each other are inserted through a connecting shaft of a main body to cause the head unit to be movable upon pushing as in PTL 2 is applied to PTL 1, the compression spring is merely replaced by the magnet. Therefore, if a position close to the outer periphery of the head unit comes into contact with a place where undulation (irregularity) of the skin surface is relatively large, the problem that the followability of the outer blade to the skin surface deteriorates cannot be solved.

Solution to Problem

The present invention is made in view of the above circumstances and an object of the invention is to provide a rotary electric shaver having a support structure in which a followability of an outer blade to a skin surface is enhanced as compared to the related art in a rotary electric shaver in which a plurality of blade units are disposed.

The present invention has been accomplished under the solutions as disclosed below.

A rotary electric shaver according to the present invention includes: a main body in which a motor and a first transmission mechanism that transmits a driving power of the motor are built, and a connecting portion is disposed; a head unit in which a plurality of blade units each having an outer blade having a circular shaving surface on an outer side, an inner blade being in sliding contact with an inner surface of the outer blade, and a driven shaft rotating the inner blade are disposed, and a second transmission mechanism that transmits a driving power of the first transmission mechanism to rotate the driven shaft is built, and which is connected to the connecting portion; and a drive shaft that transmits the driving power of the first transmission mechanism to the second transmission mechanism. The head unit has a first magnet disposed at a position corresponding to each of the blade units. The main body has a second magnet disposed at a position facing and repelling the first magnet.

According to the configuration, a support structure that floats the head unit from the main body and flexibly supports the head unit by a repulsive force between the first magnet disposed corresponding to each of the blade units and the second magnet disposed corresponding to the first magnet is provided. Since the repulsive force between the first magnet and the second magnet acts on each of the blade units, the head unit is not limited to a linear operation in an upward and downward direction such as the restoring force of the compression spring inserted through the connecting shaft of the connecting portion in the structure of the related art, and flexibly operates in any of upward, downward, rightward, leftward, frontward and rearward directions. Therefore, the support structure is provided in which a followability of the outer blade to a skin surface is enhanced as compared to the related art.

Advantageous Effects of Invention

According to the invention, a rotary electric shaver having a support structure can be realized in which a followability of an outer blade to a skin surface is enhanced as compared to the related art in a rotary electric shaver in which a plurality of blade units are disposed.

DESCRIPTION OF EMBODIMENTS

Figure 1:
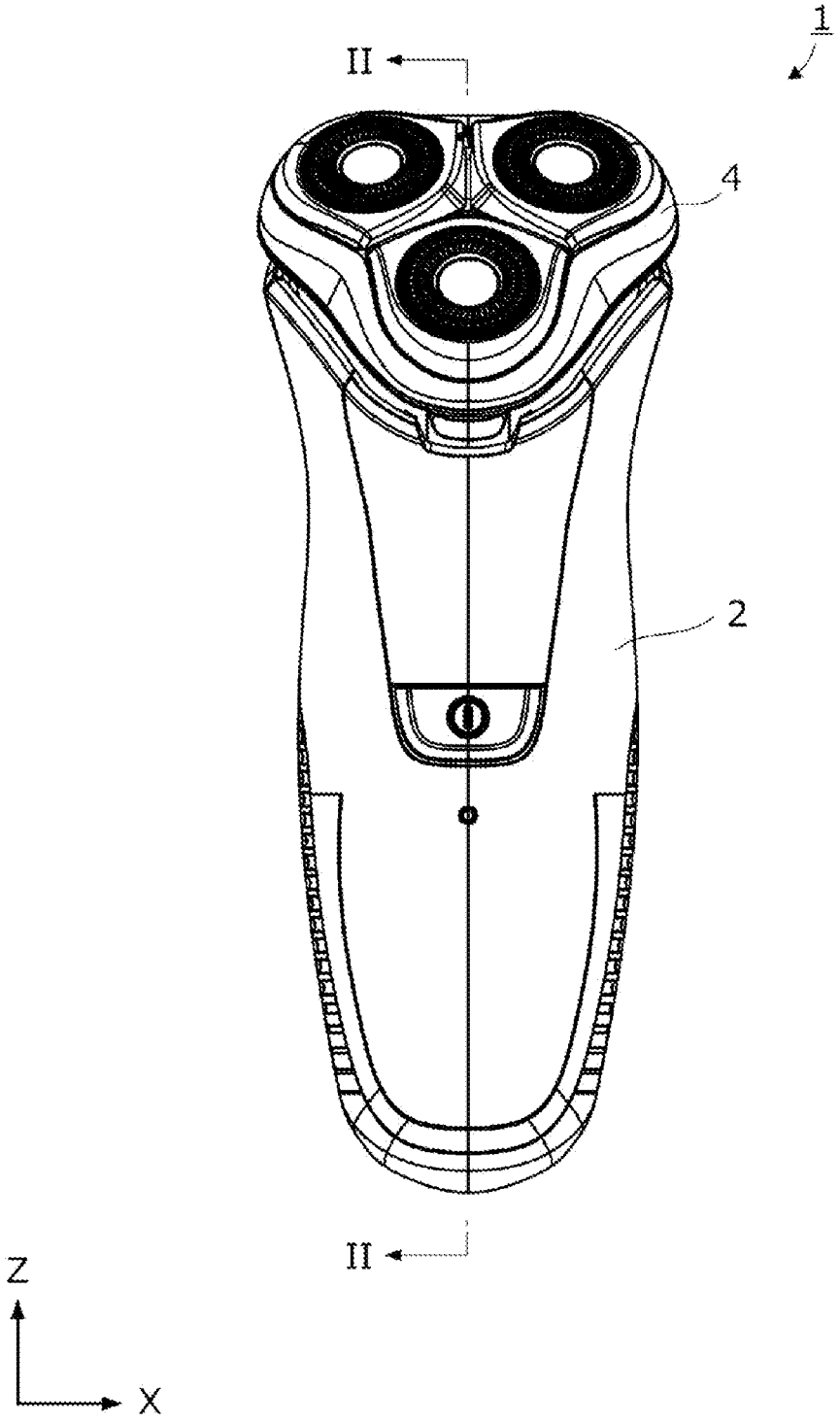
FIG. 1 is a front view schematically illustrating an example of a rotary electric shaver according to an embodiment of the invention.

Hereinafter, an embodiment of the invention will be described in detail with reference to the drawings. The embodiment is, for example, a rotary electric shaver 1 in which a plurality of blade units are disposed. Hereinafter, it may be simply referred to as the "electric shaver". Moreover, in all drawings for explaining the embodiment, the same reference numerals are given to members having the same function and repetitive description thereof may be omitted in some cases.

Figure 2:
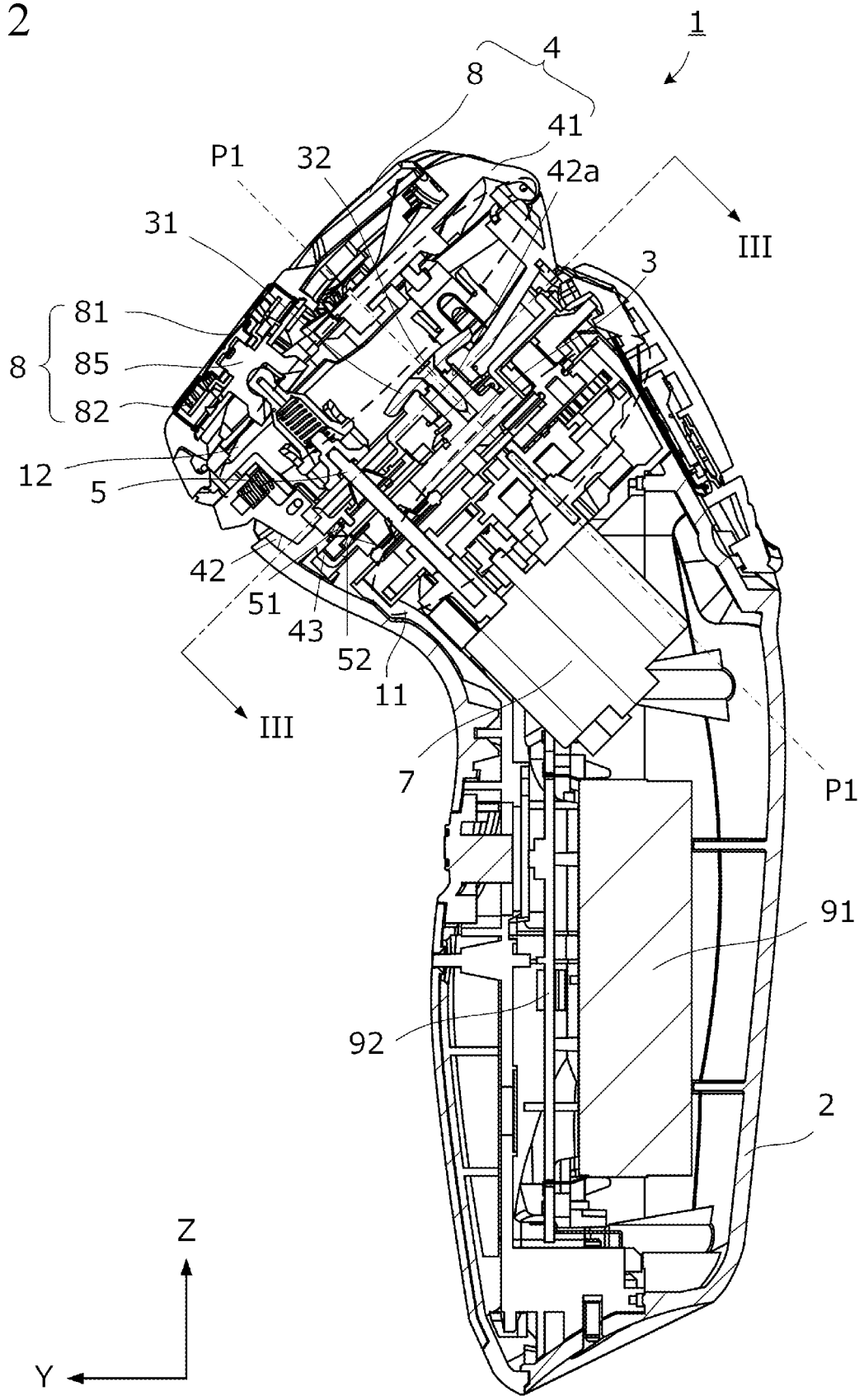
FIG. 2 is a sectional view that is taken along line II-II in FIG. 1 in which an internal structure is omitted.
Figure 3:
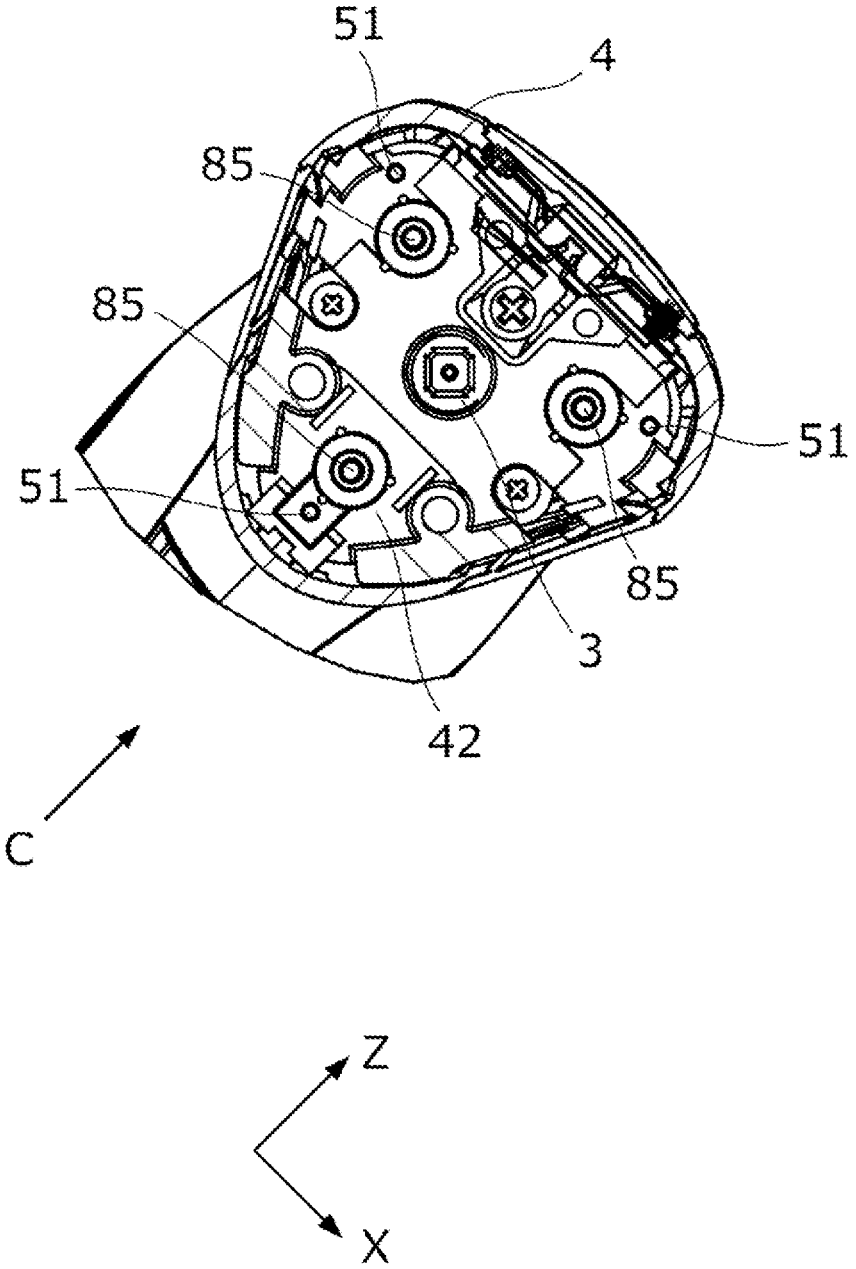
FIG. 3 is a sectional view that is taken along line in FIG. 2 in which an internal structure is omitted and is a schematic view illustrating a disposition example of a first magnet.

As illustrated in FIGS. 1 to 3, the electric shaver 1 includes, for example, a main body 2 gripped by a user and a head unit 4 connected to a connecting portion 3 which is disposed in the main body 2. Here, in order to make it easy to explain a positional relationship of each portion of the electric shaver 1, directions are indicated by arrows of X, Y, and Z in the drawings.

A front side of the main body 2 is an operation panel and a selection button for selecting an operation is provided. A motor 7, a power supply unit 91 that supplies electricity to the motor 7, and a control unit 92 that controls the motor 7 and the power supply unit 91 are built in the main body 2.

The head unit 4 is provided with a plurality of blade units 8 each having a cap-shaped outer blade 81 having a circular shaving surface on an outer side, an inner blade 82 being in sliding contact with an inner surface of the outer blade 81, and a driven shaft 85 rotating the inner blade 82. In the embodiment, three blade units 8 are disposed at equal intervals in a circumferential direction with respect to a center of the head unit 4 in a plan view. In addition, the head unit 4 includes an outer blade frame 41 that holds the blade unit 8 such that the blade unit 8 is capable of swing movement, and a blade setting base 42 which holds the outer blade frame 41.

As illustrated in FIG. 2, a first transmission mechanism 11 of a gear driving system for transmitting a driving power of the motor 7 is built in the main body 2. A second transmission mechanism 12 of a gear driving system for transmitting a driving power of the first transmission mechanism 11 via a drive shaft 5 and rotating the driven shaft 85 is built in the head unit 4. In addition, the main body 2 includes a blade setting base support plate 43 through which the drive shaft 5 penetrated and which supports the blade setting base 42. In FIG. 2, the first transmission mechanism 11 and the second transmission mechanism 12 are indicated respectively by areas surrounded by broken lines.

In the example illustrated in FIG. 2, the columnar connecting portion 3 is formed in the blade setting base support plate 43 and the connecting portion 3 is inserted into a through-hole 42*a* formed in the blade setting base 42. A lower projection portion of an inverted dish-like pressing portion 31 is attached to the through-hole 42*a* from an upper side of the blade setting base 42, and the pressing portion 31 and the connecting portion 3 are connected and fixed by a fixing member 32 such as a screw or a bolt from the upper side.

As illustrated in FIG. 3, the head unit 4 has a first magnet 51 which is disposed at a position closer to an outer periphery than the drive shaft 5 and the driven shaft 85 with respect to each of the blade units 8. The first magnet 51 is fixed to the blade setting base 42 by press fitting, bonding, embedding, or other known methods. As illustrated in FIG. 2, the main body 2 has a second magnet 52 which is disposed at a position facing and repelling the first magnet 51. The second magnet 52 is fixed to the blade setting base support plate 43 by press fitting, bonding, embedding, or other known methods. In the embodiment, three first magnets 51 and second magnets 52 are respectively disposed.

According to the configuration, a support structure that floats the head unit 4 from the main body 2 and flexibly supports the head unit 4 by a repulsive force between the first magnet 51 and the second magnet 52 is provided. Since the repulsive force between the first magnet 51 and the second magnet 52 acts on each of the blade units 8, the head unit 4 is not limited to a linear operation in an upward and downward direction as in the structure of the related art, and flexibly operates in any of upward, downward, rightward, leftward, frontward and rearward directions. Therefore, there is provided the support structure in which a followability of the outer blade 81 to a skin surface is enhanced as compared to the related art.

As illustrated in FIGS. 1 to 3, the first magnets 51 are disposed at equal intervals in the circumferential direction surrounding the connecting portion 3 as the head unit 4 is viewed from an outer blade 81 side. The same applies to the second magnets 52. According to the configuration, even in a case where a position close to the outer periphery of the head unit 4 comes into contact with a portion of a jaw or the like where undulation (irregularity) of the skin surface is relatively large, a variation of a pressing force with which the outer blade presses the skin surface by the repulsive force between the first magnet 51 and the second magnet 52 can be suppressed.

In the embodiment, the first magnet 51 and the second magnet 52 are permanent magnets, and neodymium magnets, ferrite magnets, and other known magnets can be applied. For example, a high repulsive force can be obtained while reducing a space for mounting the magnets by making the first magnet 51 and the second magnet 52 neodymium magnets.

Figure 4:
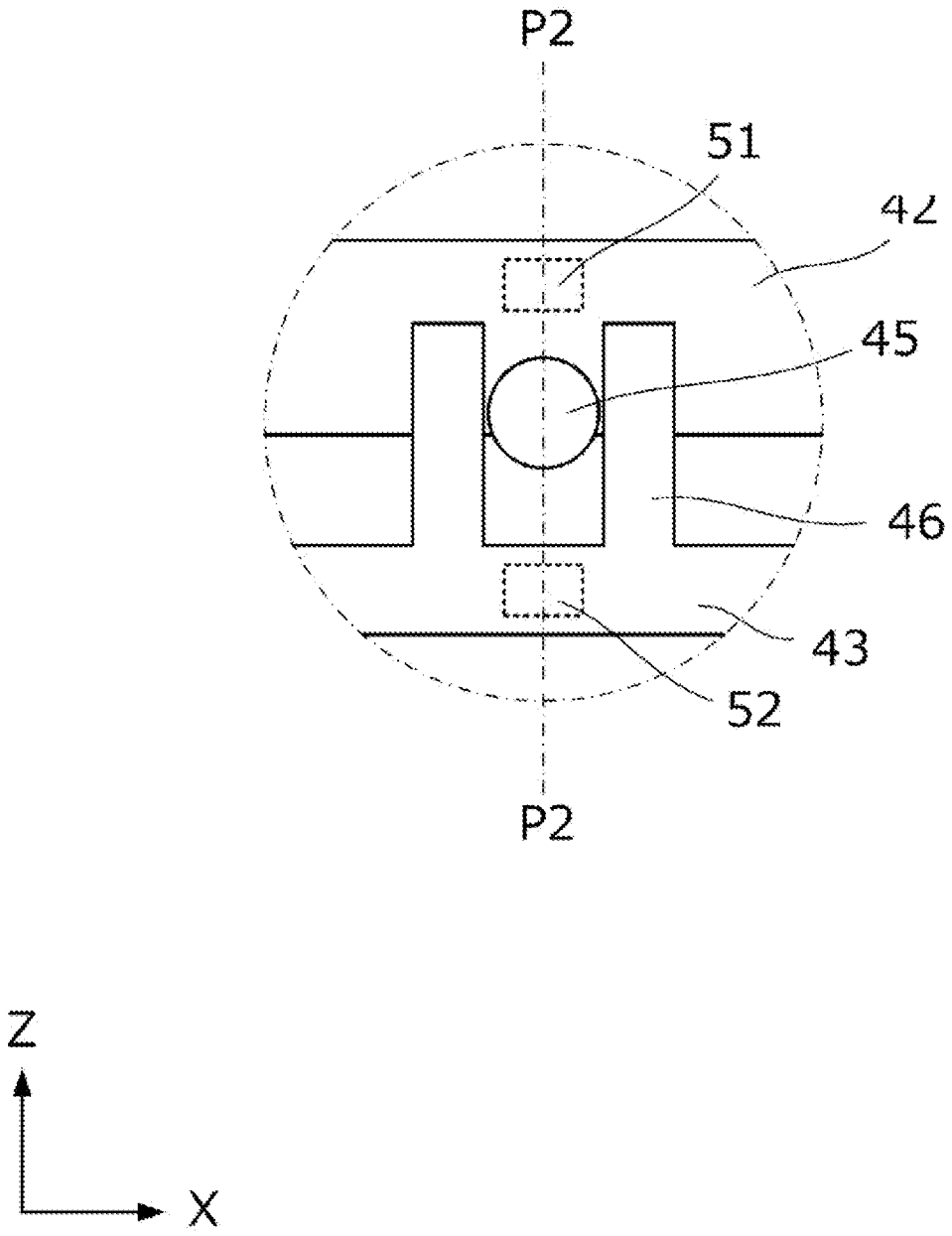
FIG. 4 is a view as viewed from C direction in FIG. 3 and is a schematic view illustrating an example of an engagement structure between a blade setting base and a blade setting base support plate.

FIG. 4 is a view as viewed from C direction in FIG. 3 and is a schematic view illustrating an example of an engagement structure between the blade setting base 42 and the blade setting base support plate 43. Line P1-P1 passing through the center of the connecting portion 3 in an axial direction and the outer blade 81 of the head unit 4 in FIG.

2 and line P2-P2 passing through the center of the first magnet 51 and the center of the second magnet 52 in FIG. 4 in the front view are in positions where they overlap each other. In the embodiment, a convex portion 45 that protrudes in a radial direction is formed at a position closer to an outer periphery than the first magnet 51 of the blade setting base 42, and a concave portion 46 that engages with the convex portion 45 in the axial direction is formed at a position closer to the outer periphery than the second magnet 52 of the blade setting base support plate 43. According to the configuration, for example, even in a case where an external force is applied in the circumferential direction of the head unit 4 by causing the head unit 4 to come into contact with the skin surface, since the convex portion 45 is engaged with the concave portion 46, it is possible to prevent the head unit 4 from rotating.

The invention is not limited to the above-described embodiment, and various modifications are possible without departing from the invention. For example, in the above-described embodiment, the first magnet 51 and the second magnet 52 adopt permanent magnets, but the invention is not limited thereto. It is possible to use an electromagnet for either or both of the first magnet 51 and the second magnet 52.

Further, for example, in the above-described embodiment, the configuration in which the three blade units 8 are disposed is described, but the invention is not limited thereto. There are cases where two blade units 8 are disposed or four or more blade units 8 are disposed.

What is claimed is:

1. A rotary electric shaver comprising:

a main body including a motor, a first transmission gear drive system that transmits a driving power of the motor, and a connecting portion that has a longitudinal axis extending in an axial direction;

a head unit including a plurality of blade units and a second transmission gear drive system, each of the plurality of blade units having an outer blade, an inner blade and a driven shaft, each outer blade having a circular shaving surface on an outer side thereof, each inner blade being in sliding contact with an inner surface of the outer blade, and each driven shaft rotating the inner blade, the head unit being connected to the connecting portion of the main body; and a plurality of drive shafts that each rotate about a shaft rotation direction parallel to the axial direction and wherein each drive shaft of the plurality of drive shafts transmits the driving power of the motor being transmitted from the first transmission gear drive system to the second transmission gear drive system so as to drive one of the respective driven shafts, wherein the head unit has a plurality of first magnets, each of the plurality of first magnets being disposed at a position corresponding to a respective one of the plurality of blade units, and wherein the main body has a plurality of second magnets respectively disposed at a position facing and repelling a corresponding one of the plurality of first magnets; and wherein the head unit further includes an outer blade frame that holds each of the blade units, and a blade setting base which holds the outer blade frame;

wherein the main body further includes a blade setting base support plate through which each drive shaft penetrates and which supports the blade setting base, the blade setting base support plate having a top surface that faces the blade setting base; and wherein the first magnets are disposed in the blade setting base and the second magnets are disposed in the blade setting base support plate; and wherein convex portions each protrude in a respective radial direction from a side surface of the blade setting base at a position farther from the connecting portion than the corresponding one of the plurality of first magnets is, the radial direction being perpendicular to the axial direction, and wherein U-shape concave portions that each guide a corresponding one of the convex portions in a direction parallel to the axial direction towards the head unit being formed on the blade setting base support plate at a position farther from the corresponding one of the connecting portions than the corresponding one of the plurality of second magnets is, each of the U-shaped concave portions including two parallel walls extending from the top surface of the blade setting base support plate that sandwich the corresponding one of the concave portions for guiding, and having an opening in the direction parallel to the axial direction.

2. The rotary electric shaver according to claim 1, wherein each of the plurality of first magnets is disposed at a position farther from the connection portion than the driven shaft is with respect to each of the blade units.

3. The rotary electric shaver according to claim 2, wherein the plurality of blade units comprise three blade units that are disposed at equal intervals from each other in a circumferential direction with respect to a center of the head unit in a plan view, the plurality of first magnets comprise three first magnets, the plurality of second magnets comprise three second magnets, and the three first magnets and the three second magnets are respectively disposed to correspond to each other, and a cooperating pair of one of the convex portions and one of the concave portions is provided to each set of one of the plurality of first magnets and the plurality of second magnets.

* * * * *